US006951599B2

(12) United States Patent
Yahalom et al.

(10) Patent No.: US 6,951,599 B2
(45) Date of Patent: Oct. 4, 2005

(54) ELECTROPOLISHING OF METALLIC INTERCONNECTS

(75) Inventors: Joseph Yahalom, Emeryville, CA (US); Deenesh Padhi, San Jose, CA (US); Srinivas Gandikota, Santa Clara, CA (US); Girish A. Dixit, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 290 days.

(21) Appl. No.: 10/188,163

(22) Filed: Jul. 1, 2002

(65) Prior Publication Data

US 2003/0155255 A1 Aug. 21, 2003

Related U.S. Application Data

(60) Provisional application No. 60/350,875, filed on Jan. 22, 2002.

(51) Int. Cl.[7] ..... C25F 7/00
(52) U.S. Cl. ..... 204/230.2; 204/224 M
(58) Field of Search ..... 204/230.2, 230.6, 204/224 M; 205/640

(56) References Cited

U.S. PATENT DOCUMENTS

| | | | |
|---|---|---|---|
| 3,873,512 | A | 3/1975 | Latanision |
| 4,125,444 | A | 11/1978 | Inoue |
| 5,096,550 | A | 3/1992 | Mayer et al. |

(Continued)

FOREIGN PATENT DOCUMENTS

| | | |
|---|---|---|
| EP | 0 325 753 | 8/1989 |
| JP | 11-42554 | 2/1999 |
| JP | 2001-77117 | 3/2001 |
| WO | 98/49723 | 11/1998 |
| WO | 99/41434 | 8/1999 |
| WO | 00/03426 | 1/2000 |
| WO | 00/26443 | 5/2000 |
| WO | 00/59682 | 10/2000 |
| WO | 01/49452 | 7/2001 |
| WO | 02/23616 | 3/2002 |
| WO | 02/064314 | 8/2002 |

OTHER PUBLICATIONS

Nogami, "An innovation in Integrate Porous Low–K Materials and Copper", Interconnect Japan 2002; Honeywell Seminar Dec. 6, 2001, p 1–12.

U.S. patent application No. 10/141,459, "*Electrolyte with Good Planarization Capability, High Removal Rate and Smooth Surface Finish for Electrochemically Controlled Copper CMP*", Sun, et al., no date avail.

(Continued)

*Primary Examiner*—Roy King
*Assistant Examiner*—Harry D. Wilkins, III
(74) *Attorney, Agent, or Firm*—Moser, Patterson & Sheridan

(57) ABSTRACT

Embodiments of the present invention generally relate to a method and apparatus for planarizing a substrate by electropolishing techniques. Certain embodiments of an electropolishing apparatus include a contact ring adapted to support a substrate, a cell body adapted to hold an electropolishing solution, a fluid supply system adapted to provide the electropolishing solution to the cell body, a cathode disposed within the cell body, a power supply system in electrical communication with the contact ring and the cathode, and a controller coupled to at least the fluid supply system and the power supply system. The controller may be adapted to provide a first set of electropolishing conditions to form a boundary layer between the substrate and the electropolishing solution to an initial thickness and may be adapted to provide a second set of electropolishing conditions to control the boundary layer to a subsequent thickness less than or equal to the initial thickness.

19 Claims, 4 Drawing Sheets

U.S. PATENT DOCUMENTS

| | | | | |
|---|---|---|---|---|
| 5,136,817 | A | 8/1992 | Tabata et al. | |
| 5,543,032 | A | 8/1996 | Datta et al. | |
| 5,567,300 | A | 10/1996 | Datta et al. | |
| 5,575,706 | A | 11/1996 | Tsai et al. | |
| 5,807,165 | A | 9/1998 | Uzoh et al. | |
| 5,911,619 | A | 6/1999 | Uzoh et al. | |
| 6,004,880 | A | 12/1999 | Liu et al. | |
| 6,056,864 | A | 5/2000 | Cheung | |
| 6,090,239 | A | 7/2000 | Liu et al. | |
| 6,103,096 | A | 8/2000 | Datta et al. | |
| 6,132,586 | A | 10/2000 | Adams et al. | |
| 6,159,079 | A | 12/2000 | Zuniga et al. | |
| 6,171,467 | B1 | 1/2001 | Weihs et al. | |
| 6,176,992 | B1 | 1/2001 | Talieh | |
| 6,203,684 | B1 * | 3/2001 | Taylor et al. | 205/103 |
| 6,234,870 | B1 | 5/2001 | Uzoh et al. | |
| 6,297,159 | B1 | 10/2001 | Paton | |
| 6,299,741 | B1 | 10/2001 | Sun et al. | |
| 6,315,883 | B1 | 11/2001 | Mayer et al. | |
| 6,391,166 | B1 | 5/2002 | Wang | |
| 6,395,152 | B1 | 5/2002 | Wang | |
| 6,440,295 | B1 | 8/2002 | Wang | |
| 6,723,224 | B2 * | 4/2004 | Yahalom et al. | 205/668 |
| 2001/0036746 | A1 | 11/2001 | Sato et al. | |
| 2001/0040100 | A1 | 11/2001 | Wang | |
| 2002/0008036 | A1 | 1/2002 | Wang | |
| 2002/0070126 | A1 | 6/2002 | Sato et al. | |

OTHER PUBLICATIONS

U.S. patent application No. 10/038,066, "*Planarization of Substrates Using Electrochemical Mechanical Polishing*", Chen, et al., no date avail.

U.S. patent application No. 10/032,275, "*Electrolyte Composition and Treatment for Electrolytic Chemical Mechanical Polishing*", Duboust, et al., no date avail.

W.C. Elmore, "*Electrolytic Polishing*", Journal of Applied Physics, Received Apr. 14, 1939.

J. Edwards, "*The Mechanism of Electropolishing of Copper in Phosphoric Acid Solutions*", Journal of the Electrochemical Society, Jul. 1953.

K. Kojima, et al. "*Interpretation of the Impedance Properties of the Anode–Surface Film in the Electropolishing of Copper in Phosphoric Acid*" J. Electrochem. Soc.: Electrochemical Science and Technology, Sep. 1973, vol. 120, No. 9.

S. H. Glarum, et al., "*The Anodic Dissolution of Copper into Phosphoric Acid*", J. Electrochem. Soc.: Electrochemical Science and Technology Dec. 1985, vol. 132, No. 12.

R.D. Grimm, et al., "*AC Impedance Study of Anodically Formed Salt Films on Iron in Chloride Solution*" J. Electrochem. Soc., vol. 139, Jun. 1992.

R. Vidal, et al., "Copper Electropolishing in Concentrated Phosphoric Acid", J. Electrochem. Soc., vol. 142, No. 8, Aug. 1995.

T.P. Hoar, "The Anodic Behaviour of Metals", Modern Aspects of Electrochemistry No. 2, Butterworths Scientific Publications 1959, no month avail.

P. A. Jacquet, "*On the Anodic Behavior of Copper in Aqueous Solutions of Orthophosphoric Acid*", A paper presented at the Sixty–ninth General Meeting, held at Cincinnati Ohio, Apr. 25, 1936.

S. Lopatin, et al. "*Characterization of Electrodissolving Copper in Aqueous Acid Solution for Sub–Quarter Micron Interconnect Formation in Low k Materials*", Electrochemical Society Proceedings vol. 99–31, no date available.

R.J. Contolini, et al., "*Electrochemical Planarization of ULSI Copper*"Jun. 1997 Solid State Technology, no month avail.

P.C. Andriacos, et al., "*Damascene Copper Electroplating for Chip Interconnections*", IBM J. Res. Develop. vol. 42, No. 5, Sep. 1998.

T. P. Moffat, et al., "*Superconformal Electrodeposition of Copper*", Electrochemical and Solid–State Letters, 4 (4) C26–C29 (2001), no month avail.

* cited by examiner

ELECTROPOLISHING OF METALLIC INTERCONNECTS

CROSS-REFERENCE TO RELATED APPLICATIONS

This application claims benefit of U.S. Provisional Patent Application Ser. No. 60/350,876, filed Jan. 22, 2002 , which is herein incorporated by reference.

BACKGROUND OF THE INVENTION

1. Field of the Invention

Embodiments of the present invention generally relate to a method and apparatus for planarizing a substrate by electropolishing techniques.

2. Description of the Related Art

Reliably producing sub-micron and smaller features is one of the key technologies for the next generation of very large scale integration (VLSI) and ultra large scale integration (ULSI) of semiconductor devices. However, as the fringes of circuit technology are pressed, the shrinking dimensions of interconnects in VLSI and ULSI technology have placed additional demands on the processing capabilities. The multilevel interconnects that lie at the heart of this technology require precise processing of high aspect ratio features, such as vias and other interconnects. Reliable formation of these interconnects is very important to VLSI and ULSI success and to the continued effort to increase circuit density and quality of individual substrates.

Currently, copper and its alloys have become the metals of choice for sub-micron interconnect technology because copper has a lower resistivity than aluminum, (1.7 $\mu\Omega$-cm compared to 3.1 $\mu\Omega$-cm for aluminum), and a higher current carrying capacity and significantly higher electromigration resistance. These characteristics are important for supporting the higher current densities experienced at high levels of integration and increased device speed. Further, copper has a good thermal conductivity and is available in a highly pure state.

FIG. 1 is a schematic cross-sectional view of one embodiment of a substrate structure 100 at one stage in the formation of a copper interconnect. Depending on the processing stage, the substrate structure 100 comprises a substrate 110, such as a semiconductor substrate or a glass substrate, and may include other materials formed over the substrate, such as a dielectric layer, conductive layer, and/or other layers. A dielectric layer 112, such as a silicon dioxide layer or a low-k dielectric layer, may be formed over the substrate 110. One example of a low-k dielectric layer is an oxidized organosilane layer or an oxidized organosiloxane layer described in more detail in commonly assigned U.S. Pat. No. 6,348,725, issued Feb. 19, 2002, which is incorporated by reference herein. The dielectric layer 112 may be patterned and etched to form apertures 114. A conductive layer 116, such as a copper seed layer and an electroplated copper bulk layer, may be deposited over the dielectric layer 112 to fill the apertures 114. A barrier layer (not shown), such as tantalum and/or tantalum nitride layer, may be formed between the dielectric layer 112 and the conductive layer 116.

As layers of materials are sequentially formed, the upper most surface of the substrate structure 100 may become non-planar. For example, the upper surface may comprise peaks 120 (or protuberances) and valleys 122 (or recesses). The difference in the height of a peak 120 and a valley 122 is called the step height 130. For example, the step height may be about 5,000 Å for a conductive layer 116 deposited to a thickness 140 of about 10,000 Å. A non-planar substrate surface may require planarization prior to further processing.

Planarizing or polishing a substrate surface is a process intended to remove material from the substrate surface to form a more planar substrate surface. Planarization is also useful in removing excess deposited material used to fill the features and in removing undesired surface topography, such as surface defects, agglomerated materials, crystal lattice damage, scratches, and contaminated layers or materials.

Chemical mechanical polishing (CMP) is one technique being used to remove conductive material from the substrate surface. Chemical mechanical polishing comprises contacting and moving a substrate surface relative to a polishing pad having a slurry or other fluid medium to remove material by chemical and mechanical forces. One problem with CMP techniques is that the down force used to contact the substrate structure and the polishing pad may affect the mechanical integrity of low-k dielectric materials formed on the substrate, which are generally porous and relatively soft. Another problem with CMP techniques is the long process time for removal of copper.

Electropolishing is another technique being explored to remove conductive material from a substrate surface. Electropolishing techniques comprise applying an anodic bias to the substrate surface to remove conductive material, such as copper, by an ion dissolution mechanism. One problem with conventional electropolishing techniques is that the step height is not sufficiently decreased before a portion of the conductive layer 116 is removed down to the dielectric layer 112 or without causing dishing of the copper filling the apertures 114. As a consequence, electropolishing a non-planar substrate surface having peaks 120 and valleys 122 does not substantially decrease the step height 130 between the peaks 120 and valleys 122.

Therefore, there is a need for an improved method and apparatus for removing conductive material from a substrate surface.

SUMMARY OF THE INVENTION

Embodiments of the present invention generally relate to a method and apparatus for planarizing a substrate by electropolishing techniques. Certain embodiments of an electropolishing apparatus include a contact ring adapted to support a substrate, a cell body adapted to hold an electropolishing solution, a fluid supply system adapted to provide the electropolishing solution to the cell body, a cathode disposed within the cell body, a power supply system in electrical communication with the contact ring and the cathode, and a controller coupled to at least the fluid supply system and the power supply system. The controller may be adapted to provide a first set of electropolishing conditions to form a boundary layer between the substrate and the electropolishing solution to an initial thickness and may be adapted to provide a second set of electropolishing conditions to control the boundary layer to a subsequent thickness less than or equal to the initial thickness.

Certain embodiments of a method of electropolishing a substrate structure include positioning a substrate structure having a copper layer in contact with an electropolishing solution, dissolving the copper layer at a first rate to form a boundary layer to an initial thickness between the substrate structure and the electropolishing solution, and dissolving the copper layer at a second rate less than the first rate to control the boundary layer to a subsequent thickness.

Certain embodiments of another method of electropolishing a substrate structure include positioning a substrate structure having a metal layer in contact with an electropolishing solution, applying a set of electropolishing conditions to provide dissolution of the metal layer at a first rate, and adjusting the set of electropolishing conditions to provide dissolution of the metal layer at a second rate less than the first rate. The step of adjusting the set of electropolishing conditions is selected from the group including decreasing substrate current density, increasing flow of the electropolishing solution, decreasing substrate potential, decreasing concentration of an electrolyte in the electropolishing solution, increasing temperature of the electropolishing solution, increasing rotational speed of the substrate structure, and combinations thereof.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Electropolishing Apparatus

Figure 2:
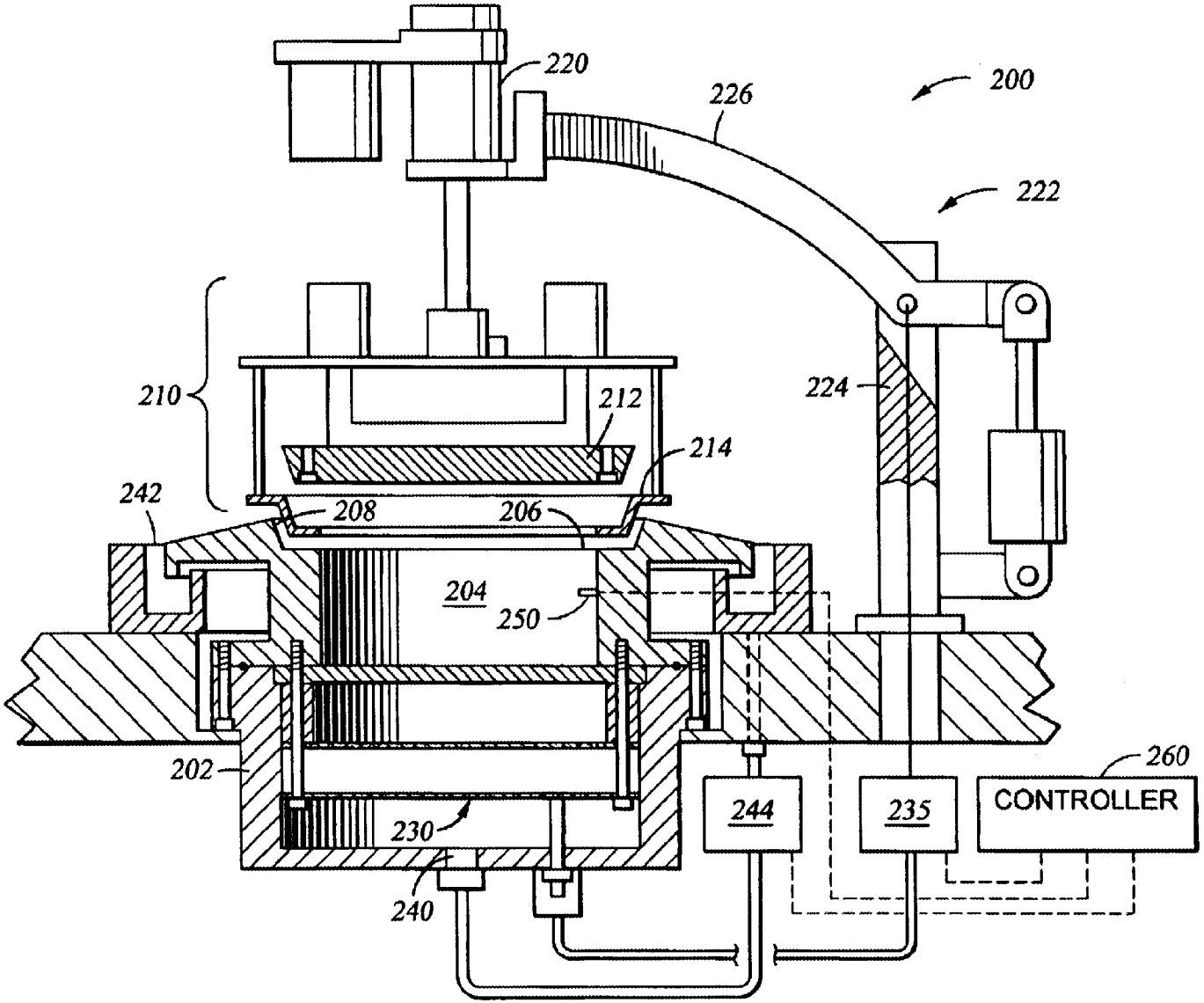
FIG. 2 is a schematic cross-sectional view of an example of one embodiment of an electropolishing cell.

FIG. 2 is a schematic cross-sectional view of an example of one example of an electropolishing cell 200 that can be used to perform the electropolishing methods disclosed. The electropolishing cell 200 comprises an Electra Cu™ ECP cell, available from Applied Materials, Inc. of Santa Clara, Calif., adapted for electropolishing. The electropolishing cell 200 generally includes a cell body 202 defining a cavity 204 to hold an electropolishing solution. A movable substrate support 210 may be positioned over an opening 206 in the cell body 202 to support a substrate structure (hereafter referred to as "substrate") "face-down" in the electropolishing solution contained in the cell body 202.

The substrate support 210 may comprise a mounting plate 212 and a contact ring 214 in which a substrate (not shown) is secured and supported therebetween during electropolishing. The contact ring 214 is sized and shaped to permit the electropolishing solution contained in the cell body 202 to contact the surface of the substrate while the substrate is immersed in the electropolishing solution. The substrate support 210 may be mounted to an actuator 220 to provide rotational movement to the substrate support 210. The actuator 220 may be mounted onto a head assembly frame 222 which includes a mounting post 224 and a cantilever arm 226 to provide vertical movement of the substrate support 210.

An electrode assembly 230 is disposed in the cavity 204 of the cell body 202. During electropolishing, one pole of a power supply system 235 is connected to the contact ring 214 while another pole of the power supply system 235 is connected to the electrode assembly 230 such that the substrate acts as an anode and the electrode assembly acts 230 as a cathode.

An electropolishing solution is supplied to the cavity 204 via an inlet 240. During electropolishing, the electropolishing solution may be supplied to the cavity 204 so the electropolishing solution overflows a lip 208 into a collector 242. The collector 242 may be coupled to the inlet 240 through a fluid supply system 244 in order to recirculate, maintain, and/or chemically refresh the electropolishing solution to the cell body 202. The fluid supply system 244 may be adapted to control the concentration of chemicals and electrolytes in the electropolishing solution. In addition, the fluid supply system 244 may include heating elements and/or cooling elements to control the temperature of the electropolishing solution delivered to the cell body 202. Alternatively, the cell body 202 may include heating elements and/or cooling elements to control the temperature of the electropolishing solution contained therein.

The electropolishing cell 200 may optionally further include a reference electrode 250, such as a calomel saturated electrode or any other electrode assemblies that have an electrode potential independent of the bias or current density used in the electropolishing cell 200. The reference electrode 250 may be used to monitor electrochemical conditions of the electropolishing cell 200, such as the potential applied to the substrate or the electrode assembly 230, depending on its placement within the electropolishing cell. Therefore, the reference electrode 250 may be used for in situ adjustment of the electrochemical conditions during electropolishing.

A control system or controller 260, such as a programmable microprocessor, may be coupled to various components of the electropolishing cell 200 to provide control signals thereto. For example, the controller 260 may be coupled to the power supply system 235 to provide control signals for the delivery of current between the contact ring 214 and the electrode assembly 230 to control substrate current density, substrate potential, and/or cell voltage. In another example, the controller 260 may be coupled to the fluid supply system 244 to provide control signals for the delivery of the electropolishing solution to the cell body 202 to control the flow rate of the electropolishing solution, the concentration of an electrolyte in the electropolishing solution, and/or the temperature of the electropolishing solution. In still another example, the controller 260 may be coupled to the actuator 220 to control the rotational speed of a substrate secured to the substrate support 210. It is to be understood that the controller 260 may be adapted to provide control signals to other electropolishing cell components.

Other electropolishing cells may also be used to advantage to perform the electropolishing methods disclosed herein. For example, other electroplating cells adapted for electropolishing may be used. In addition, an electropolishing cell adapted to perform both electropolishing and chemical mechanical polishing may also be used; however, preferably, an electropolishing cell is used which does not simultaneously perform electropolishing and chemical mechanical polishing to a substrate. In addition, the electropolishing cells may process substrates in a face-down position or in a face-up position.

Electropolishing Methods

Figure 1:
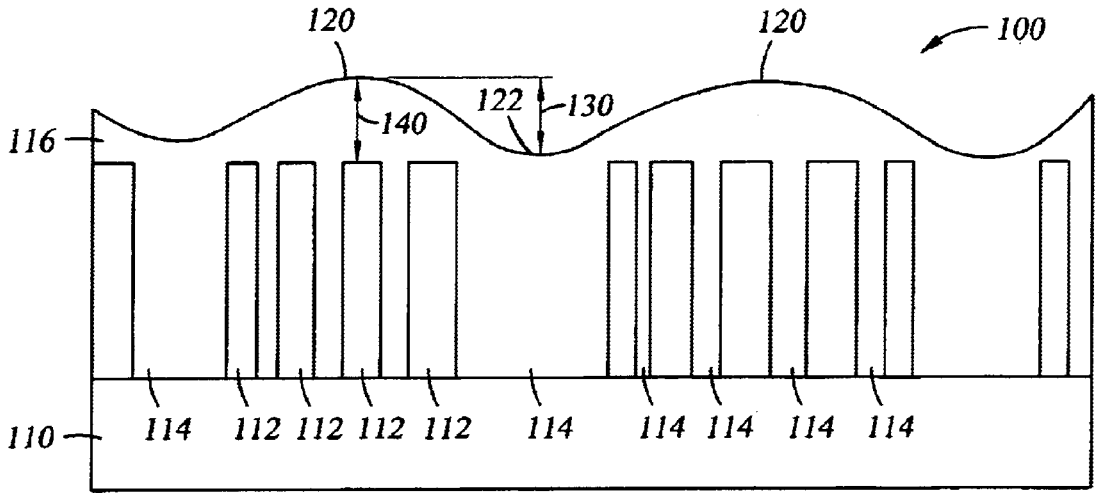
FIG. 1 is a schematic cross-sectional view of one embodiment of a substrate structure at one stage in the formation of a copper interconnect.
Figure 3:
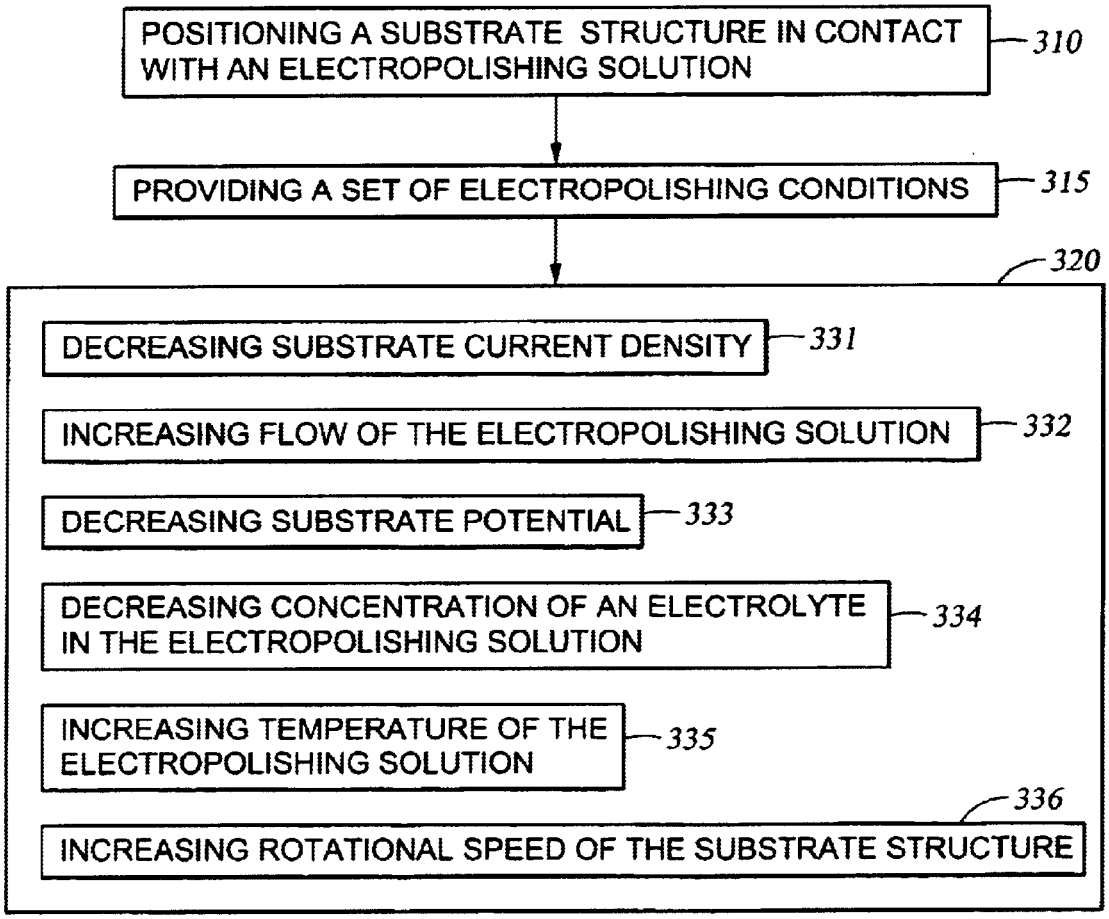
FIG. 3 is a flow chart illustrating one embodiment of a method of electropolishing a substrate structure.

FIG. 3 is a flow chart illustrating embodiments of methods of electropolishing a substrate structure. The term "electropolish" or "electropolishing" as used herein is defined as a planarizing or polishing technique comprising applying an anodic bias to a substrate to remove conductive material from the substrate surface. Electropolishing includes techniques which electropolish and chemical mechanical polish a substrate at the same time. Preferably, the electropolishing methods disclosed herein are not performed at the same time as chemical mechanical polishing methods, although chemical mechanical polishing methods may be performed separately. In step 310, a substrate structure, such as substrate structure 100 of FIG. 1, is positioned in an electropolishing cell, such as electropolishing cell 200 of FIG. 2, in contact with an electropolishing solution. It is to be understood that the electropolishing methods may also be performed in other apparatuses and may be performed on other substrate structures.

The electropolishing solution may comprise an electrolyte and water, such as deionized water. Examples of electrolytes include phosphoric acid based electrolytes, sulfuric acid based electrolytes, acetic acid based electrolytes, other suitable electrolytes, and combinations thereof. Examples of phosphoric acid based electrolytes include phosphoric acid ($H_3PO_4$) and potassium phosphate ($K_3PO_4$). In one embodiment, the electropolishing solution preferably comprises phosphoric acid ($H_3PO_4$). Examples of other suitable electrolytes include salts, acids, bases, or other compounds forming a viscous boundary layer in which copper ions are sparingly soluble as described in greater detail below. The electropolishing solution may further comprise an added source of copper ions apart from the copper ions that enter the solution as a result of the anodic dissolution of the conductive layer. Such added sources of copper ions include copper sulfate ($CuSO_4$), copper phosphate ($Cu_3(PO_4)_2$), copper chloride ($CuCl_2$), other copper halides, derivatives thereof, and combinations thereof.

In step 315, a set of electropolishing conditions is provided within the electropolishing cell to cause electropolishing of the substrate structure. In step 320, at least one of the conditions in the set of the electropolishing conditions in step 315 is changed. For example, step 320 may comprise decreasing substrate current density 331, increasing flow of the electropolishing solution 332, decreasing substrate potential 333, decreasing concentration of an electrolyte in the electropolishing solution 334, increasing temperature of the electropolishing solution 335, increasing rotational speed of the substrate structure 336, and combinations thereof. Other embodiments of the electropolishing method may include changing other electropolishing conditions. For example, the amount of copper ions added to the electropolishing solution apart from the copper ions that enter the solution as a result of anodic dissolution of the substrate structure may be controlled. Preferably, the polarity of the cell is not reversed during the electropolishing method. Reversing the current would cause metal to be plated onto the substrate instead of removing material. Therefore, the polarity of the cell is preferably maintained at an electropolishing polarity.

One embodiment of the step of decreasing substrate current density 331 comprises decreasing the substrate current density from a first substrate current density between about 60 mA/cm$^2$ and about 80 mA/cm2, preferably about 65 mA/cm$^2$, to a second substrate current density between about 15 mA/cm$^2$ and about 40 mA/cm$^2$, preferably about 22 mA/cm$^2$. Substrate current density is related to cell voltage. Another embodiment of decreasing substrate current density 331 comprises decreasing the substrate current density from a first cell voltage between about 25 volts and about 10 volts, preferably about 20 volts, to a second cell voltage between about 10 volts and about 3 volts, preferably about 5 volts. Other values for the cell voltages to obtain desired substrate current densities are also possible and depend on the dimensions of the electropolishing cell.

One embodiment of the step of increasing flow of the electropolishing solution 332 comprises increasing the flow of the electropolishing solution from a first flow rate of an electropolishing solution between about 0.0 GPM (gallons per minute) and about 0.5 GPM, preferably resulting in a stationary electropolishing solution, to a second flow rate between about 0.5 GPM and about 0.65 GPM, preferably about 0.65 GPM. Other flow rates are also possible and depend on the electropolishing cell dimensions, the size of the substrate, and other factors.

One embodiment of the step of decreasing substrate potential 333 comprises decreasing the substrate potential from a first substrate potential between about 2.0 volts and about 1.8 volts, preferably about 1.9 volts, to a second substrate potential between about 1.6 volts and about 1.0 volt, preferably about 1.5 volts. Providing a first substrate potential and providing a second substrate potential may be conducted at a constant substrate current density or at a varied substrate current density, but is preferably conducted at a substantially constant substrate current density.

One embodiment of the step of decreasing concentration of an electrolyte in the electropolishing solution 334 comprises decreasing the concentration of an electrolyte in the electropolishing solution from a first concentration of the electrolyte in the electropolishing solution between about 60% and about 85% by volume, preferably about 85% by volume, to a second concentration of the electrolyte in the electropolishing solution between about 25% and about 60% by volume, preferably about 42% by volume. The electrolyte preferably is phosphoric acid although in other embodiments other electrolytes and combinations thereof may also be used.

One embodiment of the step of increasing temperature of the electropolishing solution 335 comprises increasing the temperature of the electropolishing solution from a first temperature of the electropolishing solution between about 10° C. and about 25° C., preferably about room temperature (i.e. unheated), to a second temperature of the electropolishing solution between about 30° C. and about 65° C., preferably about 65° C.

One embodiment of the step of increasing rotational speed of the substrate structure 336 comprises increasing the rotational speed of the substrate structure from a first rotational speed between about 0 rpm and about 10 rpm, preferably between about 2 rpm and about 3 rpm, to a second rotational speed between about 10 rpm and about 100 rpm, preferably about 10 rpm.

Figure 4A:
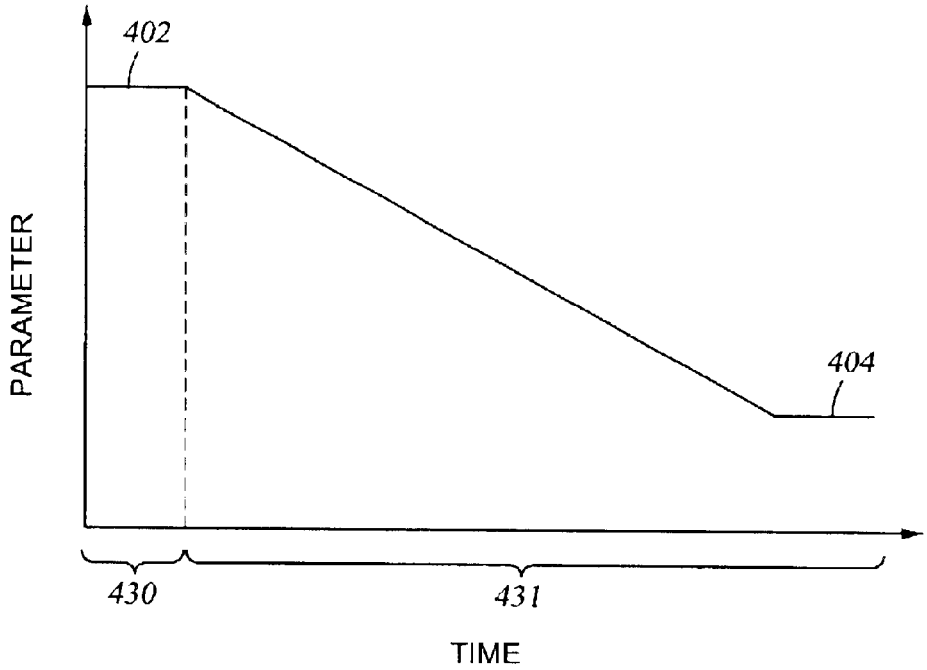
FIG. 4A illustrates one embodiment of the control signals for providing a first parameter and a second parameter.
Figure 4B:
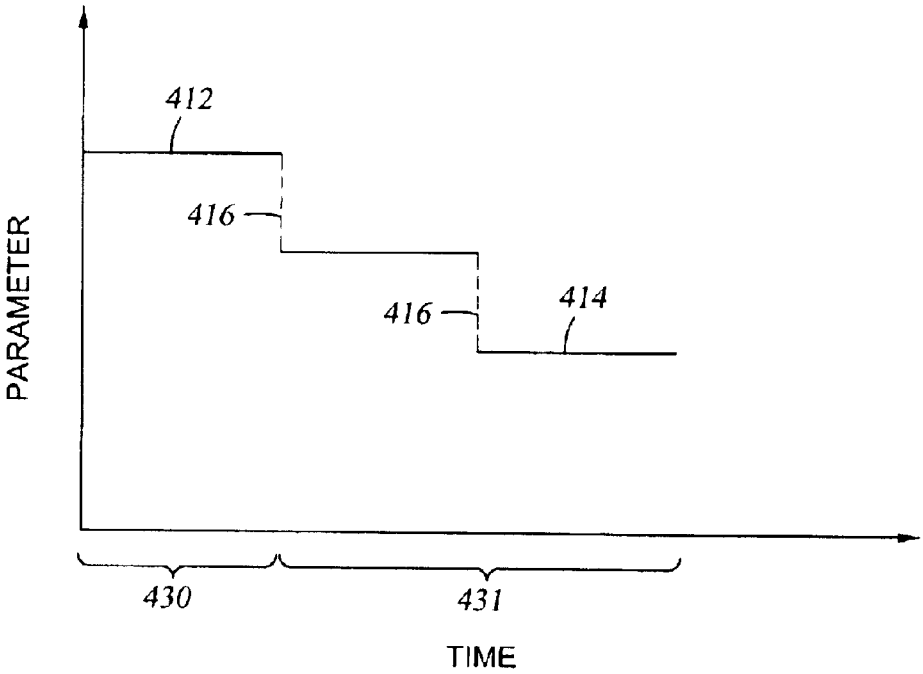
FIG. 4B illustrates one embodiment of the control signals for providing a first parameter and a second parameter.

The change from the first parameter to the second parameter of an electropolishing condition may be conducted in a variety of manners. For example, FIG. 4A illustrates one embodiment of the control signals for providing a first parameter 402 of an electropolishing condition which is gradually decreased or ramped down to a second parameter 404. FIG. 4B illustrates one embodiment of the control signals for providing a first parameter 412 of an electropolishing condition which is decreased in one or more steps 416 to a second parameter 414. In other embodiments, the change from the first parameter to the second parameter may be conducted in both gradual changes and in one or more step. Preferably, the change from the first parameter to the second parameter is conducted in a gradual change. Preferably, the change from the first parameter of an electropolishing condition to the second parameter is not provided in pulses.

In reference to FIGS. 4A and 4B, one embodiment of the method of FIG. 3 comprises providing a first parameter of one or more electropolishing conditions for a first time period 430 between about 0.1 seconds and about 60 seconds, preferably between about 5 seconds and about 20 seconds, and providing a second parameter of the electropolishing conditions for a second time period 431 (including the time period to change from the first parameter to the second parameter) of about 600 seconds or less. Other durations of the first time period 430 and the second time period 431 are possible and depend on the electropolishing conditions 331–336 changed, the magnitude of the first parameter(s) and the second parameter(s) used, and other factors. Another embodiment of the method of FIG. 3 comprises providing a first parameter of one or more electropolishing condition for a first time period 430 sufficient to cause a "sudden surge" in the substrate potential assuming that electropolishing is not conducted under potentiostatic conditions (i.e. is not conducted under constant substrate potential). The sudden surge is preferably an increase in substrate potential at least about 0.7 volts over a ten second period. Not wishing to be bound by any particular theory unless set forth in the claims, it is believed that the "sudden surge" in the substrate potential indicates the formation of a boundary layer. Another embodiment of the method of FIG. 3 comprises providing the second parameter of one or more electropolishing conditions for a second time period 431 for a desired amount of time to electropolish the substrate structure in the presence of a boundary layer at the interface of the bulk electropolishing solution and the substrate structure. The boundary layer will be discussed in greater detail elsewhere herein.

A single electropolishing condition 331–336 may be changed individually or a plurality of varied electropolishing conditions 331–336 may be changed. If a plurality of electropolishing conditions 331–336 are changed, the varied electropolishing conditions 331–336 may be changed in parallel (over the same period of time), sequentially (over different periods of time), and/or in combination (over overlapping periods of time).

Figure 5A:
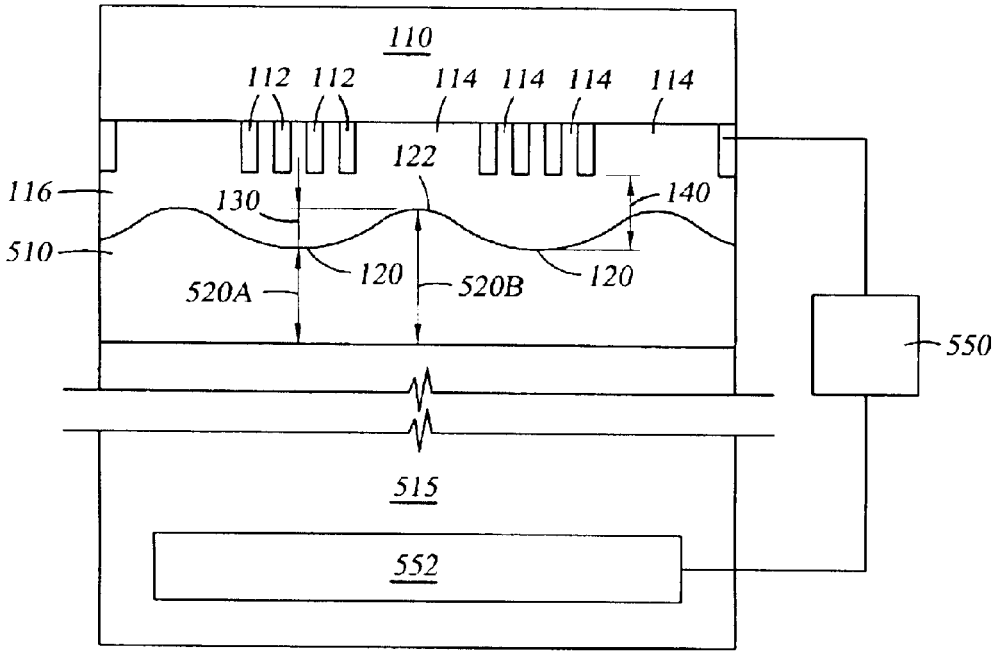
FIG. 5A is a schematic cross-sectional view of the substrate structure 100 of FIG. 1 in the initial stages of electropolishing.

Not Wishing to be bound by any particular theory unless set forth in the claims, FIG. 5A is a schematic cross-sectional view of the substrate structure 100 of FIG. 1 in an electropolishing cell, such as electropolishing cell 200 of FIG. 2, in the initial stages of electropolishing by certain embodiments of the present methods. The substrate structure 100 is positioned face-down in contact with an electropolishing solution 515. One pole of a power supply 550 is coupled to the substrate structure 100 and the other pole is coupled to an electrode 552.

It has been observed that during electropolishing, a boundary layer 510 may formed at the interface of the surface of the substrate structure 100 and the bulk electropolishing solution 515. It has been observed that this boundary layer 510 is more electrically resistive and viscous than the bulk electropolishing solution 515. For example, for electropolishing of a substrate structure comprising a copper conductive material surface and an electropolishing solution comprising a phosphoric acid based electrolyte, a boundary layer comprising a saturated solution of $Cu_3(PO_4)_2$ or a solid $Cu_3(PO_4)_2$ salt layer may form from the dissolved copper ions from the substrate structure and from the $PO_4^{3-}$ ions from the electrolyte in the electropolishing solution. As a consequence, a boundary layer 510 preferably comprises a viscous layer in which metal ions, such as copper ions, are sparingly soluble.

Not wishing to be bound by any particular theory unless set forth in the claims, it is believed that the boundary layer 510 helps reduce the step height 130 during electropolishing by providing a higher dissolution rate at a peak 120 than at a valley 122. It is believed that the thickness 520A of the boundary layer 510 at a peak 120 on the substrate structure 100 which is smaller than the thickness 520B of the boundary layer at a valley 122 on the substrate structure 100 causes the preferential dissolution of the peak 120 in comparison to the valley 122. In one embodiment, the ratio of the thickness 520A of the boundary layer 510 and the step height 130 is between about 1:4 and about 4:1 for preferential dissolution of the peak 120.

In one theory, it is believed that the higher dissolution rate at a peak 120 than at a valley 122 is caused by a shorter diffusion path for the mass-transfer of ions through the boundary layer 510. Copper can dissolve faster at the peaks 120 on the substrate surface because the copper ions diffuse through a smaller thickness 520A of the boundary layer 510 to the bulk electropolishing solution 515. This differential in rates of dissolution between the material disposed on the peaks 120 versus the material disposed on the valleys 122 leads to a reduction in the step height 130.

In another theory, it is believed that the higher dissolution rate at a peak 120 than at a valley 122 is a result of a less electrically resistive path through the boundary layer 510. The thickness 520A of the boundary layer 510 at a peak 120 provides a less electrically resistive path for current than the thickness 520B of the boundary layer 510 at a valley 122. Therefore, current preferentially flows through the peak 120 rather than through the valley 122, resulting in a higher dissolution rate at the peak 120. The mechanism in which the boundary layer 510 reduces the step height 130 may be a result of the combination of the above theories or by other mechanisms.

In one aspect, it is believed that if the boundary layer 510 is too thick, then the differences in the thickness 520A at a peak 120 and thickness 520B at a valley 122 will be small. Therefore, the difference in the diffusion path and/or electrical resistance through the boundary layer 510 will be minor resulting in a minor difference between the dissolution rates at the peak 120 and at the valley 122 and resulting in a negligible reduction of the step height 130.

In another aspect, it is believed that if the boundary layer 510 is too thin, then the boundary layer 510 will not provide sufficient diffusion limiting or electrical resistance to provide a preferential dissolution of a peak 120 in comparison to a valley 122. Furthermore, it is believed that if the boundary layer 510 is too thin or has not yet formed, such as when electropolishing is initially conducted, it is believed the dissolution will preferably occur on grains that are oriented at a crystallographic direction to the surface more prone to dissolution, and/or at grain boundaries resulting in the release of metal grains into the electropolishing solution and roughening of the substrate surface. Therefore, prior to the formation of a suitable boundary layer, the substrate surface may be "etched" by electropolishing conditions rather than polished.

It is believed that controlling the substrate current density, the flow of the electropolishing solution, the substrate potential, the concentration of an electrolyte in the electropolishing solution, the temperature of the electropolishing solution, and/or the rotational speed of the substrate structure influences the formation of the boundary layer and/or the thickness of the boundary layer which in turn influences the planarization of substrate structure. In one embodiment, preferably the current density and/or the flow of the electropolishing solution is controlled to influence the boundary layer formation and thickness due to the ease of manipulating these conditions.

In reference to FIG. 5A, in one aspect, it is believed that that the first parameter(s) of the method of FIG. 3 helps form a boundary layer 510 at the interface of the surface of the substrate structure 100 and the bulk electropolishing solution 515 by depleting a reduced amount of the conductive layer 116. For example, a relatively high substrate current density and/or a relatively high substrate potential causes metal ions to dissolve from the substrate structure 100 at a greater rate than metal ions can diffuse into the bulk electropolishing solution 515. Similarly, a relatively low flow of the electropolishing solution, a relatively low rotational speed of the substrate structure 100, and/or a relatively low temperature of the electropolishing solution 515 reduces the rate of diffusion of the metal ions from the surface of the substrate structure 100 into the bulk electropolishing solution 515. In another example, the relatively high concentration of electrolyte in the electropolishing solution 515 or the high concentration of metal ions, such as copper ions, added to the electropolishing solution 515 also helps form the boundary layer by reducing the solubility of the metal ions in the electropolishing solution 515. Not wishing to be bound by any particular theory unless set forth in the claims, it is believed that forming a boundary layer 510 by depleting a relatively reduced amount of the conductive layer 116 from the substrate surface leaves a greater thickness of the conductive layer 116 to be electropolished in the presence of a boundary layer 510. Therefore, the step height 130 between the peaks 120 and valleys 122 of the substrate surface may be further reduced.

In another aspect, in reference to FIG. 5A, it is believed that changing from the first parameter(s) to the second parameter(s) of the method of FIG. 3 helps to reduce the thickness of the boundary layer 510 as the thickness of the conductive layer 116 and the step height 130 decreases. For example, it is believed that decreasing the substrate current density and/or the substrate potential during electropolishing acts to decrease the thickness of the boundary layer 510 by reducing the rate of dissolution of the metal ions which form the boundary layer 510. In another example, it is believed that increasing the flow of the electropolishing solution, increasing the rotational speed of the substrate structure 100, and/or increasing the temperature of the electropolishing solution increases the rate of diffusion of the metal ions from the surface of the substrate structure 100 to the bulk electropolishing solution 515 and, thus, the increases the dissipation of the boundary layer 510. In still another example, it is believed that decreasing the concentration of the electrolyte in the electropolishing solution and/or decreasing the amount of added metal ions, such as copper ions, in the electropolishing increases the solubility of the metal ions in the electropolishing solution and, thus, reduces the thickness of the boundary layer 510. Not wishing to be bound by any particular theory unless set forth in the claims, it is believed that reducing the thickness of the boundary layer 510 as the thickness of the conductive layer 116 decreases enhances reduction of the step height 130 between peaks 120 and valleys 122 by preventing the thickness of the boundary layer 510 from becoming too large. It is believed that if the boundary layer 510 is too thick, then the differences in the thickness 520A at a peak 120 and 520B at a valley 122 will be small resulting in a minor difference between the dissolution rates at the peak 120 and at the valley 122. In one embodiment, the change from the first parameter(s) to the second parameter(s) preferably occurs by a gradual change so that the boundary layer thickness corresponds to the changing step height 130 through progressing stages of planarization.

Figure 5B:
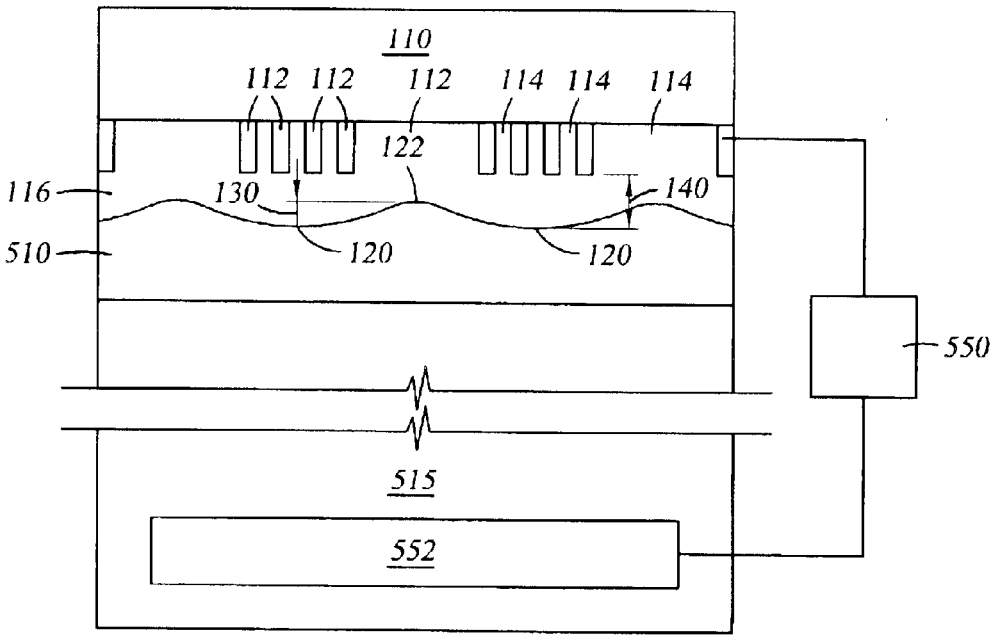
FIG. 5B is a schematic cross-sectional view of the substrate structure 100 in FIG. 1 in the later stages of electropolishing.

FIG. 5B is a schematic cross-sectional view of the substrate structure 100 of FIG. 1 in an electropolishing cell in the later stages of electropolishing by certain embodiments of the present methods. The step height 130 of the substrate structure 100 has been reduced along with the thickness 140 of the conductive layer 116. Preferably, the thickness 140 of the conductive layer 116 is not reduced to such an extent that the conductive materials in the apertures 114 are substantially removed. Performing the electropolishing methods as described herein has been observed to reduce the step height of a substrate structure by about 60% or more (i.e., a step height of 5,000 Å before electropolishing and a step height of 2,000 Å or less after electropolishing), preferably by about 80% or more, and more preferably by about 90% or more.

The present electropolishing methods may be performed alone to planarize a substrate structure or may be performed in conjunction with subsequent chemical mechanical polishing of the substrate structure to further reduce the step height and/or remove excess material from the substrate surface. Examples of chemical mechanical polishing systems include, but are not limited to the MIRRA™ system, the MIRRA MESA™ system, and the REFLEXION™ system, all available from Applied Materials, Inc. of Santa Clara, Calif. Because the present electropolishing methods reduce the step height and the excess material on a substrate surface, subsequent chemical mechanical polishing processes of the substrate structure are simplified. Therefore, the present electropolishing methods may be used to advantage in the planarization of substrate structures comprising low-k materials. Of course, the present electropolishing methods may be used to advantage in the planarization of substrate structures comprising other dielectric materials.

EXAMPLES

The following examples will now be described and set forth details and features concerning embodiments of electropolishing of a substrate structure. The following examples should not be construed to limit the scope of the invention unless expressly set forth in the claims. For the following Examples 1–8, substrates were electropolished under various electropolishing conditions. Each substrate comprised a 200 mm silicon substrate having various trench widths from about 0.2 μm to about 5 μm. The substrates were deposited with a Ta/TaN diffusion barrier layer followed by a thin copper seed layer formed by physical vapor deposition. Subsequently, the trenches were filled with a bulk copper layer by electroplating utilizing an electroplating solution comprising copper sulfate, sulfuric acid, copper chloride, and multiple organic additives. The thickness of the bulk copper layer varied from about 1 μm to about 8 μm.

The substrates were electropolished using an electropolishing cell system comprising a copper cathode electrode, a substrate support having a contact ring, a power supply, a cavity to hold an electropolishing solution, a flow plumbing, software interface, and a saturated calomel reference electrode. The substrates were positioned in the electropolishing cell "face-down" in an electropolishing solution comprising 85% phosphoric acid solution at room temperature.

Comparative Example 1

Substrate 1 was electropolished at a substrate current density of about 22.3 mA/cm$^2$ for a time period of about 80 seconds. The substrate potential ($V_{sce}$) was measured in reference to an SCE (saturated calomel electrode) reference electrode as a function of time. The results are reflected in Table 1. Scanning electron microscope (SEM) photographs of a cross-section of Substrate 1 were taken before and after electropolishing.

As shown in Table 1, the substrate potential was substantially constant at about 0.4 V or less during electropolishing. The SEM photograph of Substrate 1 after electropolishing showed a very rough substrate surface. The surface of Substrate 1 was rougher after electropolishing than prior to electropolishing. The step height (i.e. the height between the peaks and valleys on the surface of the substrate) prior to electropolishing was about 0.40 $\mu$m. After electropolishing, the step height remained at about 0.40 $\mu$m.

It is believed that under these electropolishing conditions, dissolution of a considerable portion of the original thickness of the plated copper was not sufficient to form and maintain a boundary layer. Therefore, selective electropolishing did not occur and thus step height was not reduced by electropolishing. Furthermore, it is believed since there was no selective electropolishing, dissolution of the copper occurred at grain boundaries releasing grains of copper and resulted in a rough substrate surface (i.e. etching of the substrate surface).

TABLE 1

| Potential Transient Substrate I | |
|---|---|
| Time (sec) | Substrate Potential ($V_{sce}$) |
| 5 | 0.35 |
| 20 | 0.354 |
| 40 | 0.3629 |
| 60 | 0.37 |
| 75 | 0.37 |
| 80 | 0.388 |

Example 2

Substrate 2 was electropolished at a rotational speed of about 10 rpm. A polarization curve was obtained by measuring the substrate current density as a function of the substrate potential in reference to an SCE reference electrode. The polarization curve was obtained by utilizing a current scan with a controlled current power supply. The results are shown in Table 2.

As shown in Table 2, initially, the current density rises with an increase in substrate potential from about 0.0 V to about 0.4 V. From a substrate potential from about 0.4 V to about 1.3 V, the current density reaches a plateau at a substantially constant level. From a substrate potential above about 1.3 V, the substrate current density begins to rise with substrate potential.

Not wishing to be bound by any particular theory unless set forth in the claims, it is believed that the plateau in the substrate current density at a substrate potential from about 0.4 V to about 1.3 V is indicative of the presence of a resistive boundary layer at the substrate/electropolishing solution interface. It is believed that the thickness (or the resistivity) of the boundary layer increases with the substrate potential in the plateau region as inferred from the unchanged value of the substrate current density at the increasing substrate potentials from about 0.4 V to about 1.3 V. From the practically equal values of the substrate current densities in the plateau region, it can be inferred that the thickness and/or the resistance of the boundary layer is directly proportional to the substrate potential. In other electropolishing systems and conditions, the plateau region may occur at a different current density. It is believed that the rise of the substrate current density from a substrate potential above about 1.3 V is due to oxygen evolution which may be detrimental to electropolishing.

TABLE 2

| Polarization Behavior Substrate 2 | |
|---|---|
| Substrate Current Density (mA/cm$^2$) | Substrate Potential (m$V_{sce}$) |
| 0 | 42 |
| 3.501409 | 121 |
| 6.684508 | 165 |
| 9.867606 | 211 |
| 13.05071 | 260 |
| 15.59718 | 298 |
| 18.78028 | 350 |
| 20.69014 | 375 |
| 22.28169 | 400 |
| 23.87324 | 420 |
| 23.87324 | 420 |
| 24.50986 | 1280 |
| 25.46479 | 1300 |
| 28.64789 | 1360 |
| 34.69578 | 1520 |
| 41.06198 | 1650 |

Example 3

Various substrates were electropolished at different constant substrate current densities at an electropolishing solution flow rate of about 0.15 GPM. The substrates were not rotated (i.e., rotational speed of 0 rpm). Substrate 3 was electropolished at a constant substrate current density of about 19 mA/cm$^2$. Substrate 4 was electropolished at a constant substrate current density of about 25.5 mA/cm$^2$. Substrate 5 was electropolished at a constant substrate current density of about 31.8 mA/cm$^2$. Substrate 6 was electropolished at a constant substrate current density of about 47.7 mA/cm$^2$. Substrate 7 was electropolished at a constant substrate current density of 63.6 mA/cm$^2$. The substrate potential was measured as a function of time at the various constant current substrate densities. The results are reflected in Table 3.

As shown in Table 3, Substrate 3 showed a substantially constant substrate potential over time. Substrates 4–7 showed an initial low substrate potential between about 0.4 V and about 0.6 V depending on the substrate current density. Then, over a short period of time relative to each substrate, the substrate potential increased to a high value between 1.7 and 2.5 V depending on the substrate current density. This surge in substrate potential occurred earlier in time for higher substrate current densities.

It is believed that the rise in the substrate potential over time for Substrates 4–7 is indicative of the formation of a resistive boundary layer. It is believed that the formation of the boundary layer occurs faster for higher substrate current densities. As a consequence, it is believed that the boundary layer is thicker a higher potentials due to the faster dissolution of copper ions from the substrate surface in comparison to the diffusion of the copper ions to the bulk electropolishing solution. The boundary layer is believed to be substantially stable in time as shown in the substantially constant substrate potential values after the surge indicating a constant steady-state boundary layer.

It is believed that the substantially constant substrate potential of Substrate 3 shows that a minimum substrate current density is needed to form and maintain a boundary layer.

TABLE 3

Time Evolution of Substrate Potential

| | Substrate Potential ($V_{sce}$) | | | | |
|---|---|---|---|---|---|
| Time (sec) | Substrate 3 19 mA/cm$^2$ | Substrate 4 25.5 mA/cm$^2$ | Substrate 5 31.8 mA/cm$^2$ | Substrate 6 47.7 mA/cm$^2$ | Substrate 7 63.6 mA/cm$^2$ |
| 0 | 0.32 | 0.34 | 0.37 | 0.49 | 0.61 |
| 10 | | 0.34 | 0.38 | 0.51 | 0.67 |
| 20 | | 0.35 | 0.39 | 0.54 | 2.1 |
| 30 | 0.40 | 0.36 | 0.4 | 0.62 | 2.13 |
| 40 | | 0.37 | 0.41 | 1.96 | 2.2 |
| 50 | | 0.37 | 0.42 | 1.98 | 2.2 |
| 60 | 0.495 | 0.38 | 0.45 | 1.98 | 2.23 |
| 70 | | 0.39 | 1.86 | 1.99 | |
| 80 | | 0.4 | 1.85 | 2 | |
| 90 | 0.44 | 0.41 | 1.84 | 2.01 | |
| 100 | | 1.81 | 1.83 | | |
| 110 | | 1.78 | | | |
| 120 | 1.82 | 1.8 | | | |

Example 4

Various substrates were electropolished at different rotational speeds. Each substrate was electropolished at a constant substrate current density of about 25 mA/cm$^2$. Substrate 8 was not rotated (0 rpm). Substrate 9 was rotated at 10 rpm. Substrate 10 was rotated at about 15 rpm. Substrate 11 was rotated at about 25 rpm. Substrate 12 was rotated at about 50 rpm. The substrate potentials of the substrates were measured as a function of time. The results are reflected in Table 4.

As shown in Table 4, Substrates 8–12 showed an initial low substrate potential between about 0.3 V and about 0.5 V. Then, over a short period of time relative to each substrate, the substrate potential increased to a high value between about 1.4 V and about 1.9 V depending on the rotational speed. This surge in substrate potential occurred earlier in time for lower rotational speeds.

Not wishing to be bound by any particular theory unless set forth in the claims, it is believed that during the initial low substrate potential, copper starts to dissolve mostly from the grain boundaries and crystallographically preferential sites, thus resulting in etching of the surface. With time, it is believed that a gradual build-up of copper ions near the surface of substrate occurs. It is believed that the surge in substrate potential indicates that the solubility limit of the copper ions in $H_3PO4$ has been reached at the electropolishing solution interface. At this point, it is believed that any further dissolution requires the movement of copper ions from near the substrate surface to the bulk electropolishing solution, which is fixed by the diffusion constant of $Cu^{2+}$ in the electropolishing solution. This leads to the formation of a resistive boundary layer near the substrate surface manifested by the surge in the substrate potential. It is believed that a fixed amount of copper ions needs to be accumulated near the substrate surface for the formation and maintenance of a steady-state boundary layer at given hydraulic conditions at a given current density. It is believed that at high rotational speed, the transport of dissolved copper ions is more efficient. Thus, the higher the rotational speed, the more time and amount of metal dissolution is needed for the accumulation of copper ions prior to the creation of the boundary layer. It is believed that the boundary layer is thinner at higher rotational speeds based on the relative lower "high value substrate potential" observed for substrates rotated at higher rpms.

It is believed that in the initial stages (i.e., prior to the formation of the boundary layer) charge transfer at the electropolishing solution interface is the dominant factor in determining the rate of copper dissolution rather than diffusion because rotational speed has a small effect on the substrate potential prior to formation of the boundary layer.

TABLE 4

Time Evolution of Substrate Potential as a Function of Rotational Speed

| | Substrate Potential ($V_{sce}$) | | | | |
|---|---|---|---|---|---|
| Time (sec) | Substrate 8 0 RPM | Substrate 9 10 RPM | Substrate 10 15 RPM | Substrate 11 25 RPM | Substrate 12 50 RPM |
| 5 | | 0.34 | 0.35 | 0.35 | 0.36 |
| 30 | 0.44 | 0.36 | 0.37 | 0.36 | 0.38 |
| 45 | | | | 0.37 | 0.38 |
| 60 | 0.46 | 0.382 | 0.384 | 0.38 | 0.39 |
| 75 | | | 0.4 | 0.39 | 0.4 |
| 90 | 1.82 | 1.854 | 0.54 | 0.41 | 0.4 |
| 105 | | | 1.77 | | 0.41 |
| 120 | 1.83 | 1.85 | 1.78 | 1.75 | 0.4 |
| 135 | | | | | 0.42 |
| 150 | 1.84 | 1.812 | 1.79 | 1.75 | 1.51 |
| 180 | 1.85 | 1.79 | 1.79 | 1.75 | 1.43 |
| 210 | 1.84 | 1.794 | 1.79 | 1.74 | 1.66 |

Theoretical Example 5

Not wishing to be bound by any particular theory unless set forth in the claims, Table 5 shows the calculated thickness of copper that is required to be dissolved on order to establish the steady-state polishing boundary as a function of substrate current density. It is believed that the amount of copper necessary to be dissolved for formation of the boundary layer increases with decreasing current density. It is believed that at low current densities, the slow rate at which the copper ions are generated allows most of the copper ions to diffuse into the bulk electropolishing solution before the buildup of the boundary layer. Therefore, more time and copper consumption are needed to accumulate an adequate amount of copper ions order to form the boundary layer. Conversely, it is believed that at higher current densities, copper is dissolved at a much higher rate than the rate of diffusion and the build-up of copper ions occurs much faster.

TABLE 5

Amount of Copper Dissolved Prior to Onset of Boundary Layer as a Function of Current Density

| Substrate Current Density (mA/cm$^2$) | Thickness of Dissolved Copper (Å) |
|---|---|
| 22.28169 | 10211.42 |
| 25.46479 | 9772.597 |
| 31.83099 | 7353.168 |
| 38.19719 | 5977.414 |

TABLE 5-continued

| Amount of Copper Dissolved Prior to Onset of Boundary Layer as a Function of Current Density | |
|---|---|
| Substrate Current Density (mA/cm$^2$) | Thickness of Dissolved Copper (Å) |
| 44.56338 | 5479.296 |
| 50.92958 | 4743.979 |
| 56.65916 | 4011.034 |
| 63.02536 | 3757.232 |

Example 6

Various substrates were electropolished at different constant substrate current densities. Substrate 13 was electropolished at a constant substrate current density of less than about 15 mA/cm$^2$. Substrate 14 was electropolished at a constant substrate current density of about 19.1 mA/cm$^2$. Substrate 15 was electropolished at a constant substrate current density of about 22.3 mA/cm$^2$. Substrate 16 was electropolished at a constant substrate current density of about 25.5 mA/cm$^2$. Substrate 17 was electropolished at a constant substrate current density of about 63.7 mA/cm$^2$. The time of electropolishing of each substrate was varied to pass an equal amount of charge for all the substrates and thus remove approximately the same thickness of copper metal at each substrate current density. For example, Substrate 13 was electropolished for a longer time period than Substrate 17. SEM photographs were taken of a cross-section of the substrates before and after electropolishing.

The surface of Substrate 13 after electropolishing looked ruddy and dull. The SEM photograph of Substrate 13 after electropolishing showed that the topography of the substrate surface was very rough. The SEM photographs of Substrates 14–16 after electropolishing showed substrate surfaces which were substantially smooth. The SEM photographs of Substrate 15–16 after electropolishing showed a reduction in the step height from about 6,000 Å to about 2,000 Å better than the reduction of step height of Substrate 14. Substrate 17 after electropolishing showed a substrate surface which was rough.

Not wishing to be bound by any particular theory unless set forth in the claims, it is believed that the rough surface of Substrate 13 after electropolishing was caused by the lack of formation of a boundary layer resulting in etching rather than polishing of the copper layer. It is believed that the smooth surfaces of Substrates 14–16 after electropolishing were caused by the formation of boundary layers at higher substrate current densities. It is believed that the rough surface of Substrate 17 after electropolishing was caused by oxygen-evolution which results in non-uniform polishing due to partial masking by oxygen bubbles. It is believed that masking by oxygen bubbles poses less of a problem for electropolishing systems in which the substrate is positioned "face-up."

Example 7

Various substrates were electropolished at different rotational speeds at a constant substrate current density at about 22.3 mA/cm$^2$ for about 210 seconds. Substrate 18 was not rotated (i.e. 0 rpm). Substrate 19 was rotated at 5 rpm. Substrate 20 was rotated at 10 rpm. Substrate 21 was rotated at 25 rpm. Substrate 22 was rotated at 50 rpm. SEM photographs were taken of a cross-section of the substrates prior to electropolishing and subsequent to electropolishing.

The SEM photograph of Substrate 18 after electropolishing showed a substrate surface which was non-planar. It is believed, that at very low rotational speeds (such as less than 4 rpm), bubbles may be trapped against the surface of the substrate during immersion of the substrate into the electropolishing solution resulting in pockets of areas on the surface of the substrate without any copper dissolution. The SEM photographs of Substrates 19 and 20 after electropolishing showed substrate surfaces which were substantially planar. The SEM photograph of Substrate 21 after electropolishing showed a substrate surface which was substantially planar but less planar than Substrates 19 and 20. The SEM photograph of Substrate 22 after electropolishing showed a substrate which was non-planar.

Example 8

Various substrates were electropolished at a constant substrate current density of about 22.3 mA/cm$^2$ and rotated at about 10 rpm for different durations. Substrate 23 was electropolished for 0 seconds. Substrate 24 was electropolished for about 350 seconds. Substrate 25 was electropolished for about 450 seconds. Substrate 26 was electropolished for about 550 seconds. SEM photographs were taken of a cross-section of the substrates after electropolishing. The step height of the substrates were measured from the SEM photographs.

The step height of Substrate 23 was about 5,450 Å. The step height of Substrate 24 was about 2,500 Å. The step height the Substrate 25 was about 2,000 Å. The step height of Substrate 26 was about 2,600 Å.

Not wishing to be bound by any particular theory unless set forth in the claims, it is believed that the step height is reduced during electropolishing over time because of the increased amount of copper removed from peaks relative to valleys under the influence of a boundary layer. It is believed that the increase of the step height from Substrate 25 to Substrate 26 was caused by over polishing of the copper layer.

Example 9

For Example 9, a substrate was electropolished under a first current density and under a second current density. The substrate comprised a silicon substrate having a low-k dielectric layer of silicon oxy-carbide deposited thereover. Features were formed in the dielectric layer including narrow features having a width of about 0.1 $\mu$m and wide features having widths between 0.2 $\mu$m and 5 $\mu$m at an aspect ratio (a ratio of height to width) of about 6:1. A barrier layer of tantalum/tantalum nitride was deposited at about 1000 Å thick over the feature definitions. Then, a copper containing layer (including a copper seed layer) was deposited between about 8000 Å and about 18,000 Å thick over the barrier layer.

The substrate was then electropolished at a rotational speed between about 5 rpm and 10 rpm in an electropolishing solution comprising about 85% $H_3PO_4$ at a temperature of about 20° C. (room temperature) in which the electropolishing solution was flowed in at a rate of about 0.15 GPM. A first substrate current density of about 65 mA/cm$^2$ was applied for about 15 seconds and a second substrate current density of about 22.3 mA/cm$^2$ was applied for about 600 seconds. SEM photographs were taken of the substrate before and after electropolishing. The SEM photograph before electropolishing showed step heights between about 5,000 Å and about 9,000 Å. The SEM photograph after electropolishing showed step heights of about 2000 Å.

While the foregoing is directed to embodiments of the present invention, other and further embodiments of the invention may be devised without departing from the basic scope thereof, and the scope thereof is determined by the claims that follow.

What is claimed is:

1. An electropolishing apparatus, comprising:

a contact ring adapted to support a substrate;

a cell body adapted to hold an electropolishing solution;

a fluid supply system adapted to provide the electropolishing solution to the cell body;

a cathode disposed within the cell body;

a power supply system in electrical communication with the contact ring and the cathode; and a controller coupled to at least the fluid supply system and the power supply system, the controller adapted to provide a first set of electropolishing conditions to form a boundary layer between the substrate and the electropolishing solution to an initial thickness and adapted to provide a second set of electropolishing conditions to control the boundary layer to a subsequent thickness less than or equal to the initial thickness.

2. The apparatus of claim 1, wherein the boundary layer comprises a viscous layer in which copper ions are sparingly soluble therein.

3. The apparatus of claim 1, wherein the controller is adapted to change from the first set of electropolishing conditions to the second set of electropolishing conditions in one or more gradual changes, one or more step changes, or combinations thereof.

4. The apparatus of claim 1, wherein the controller is adapted to provide a current between the contact ring and the cathode in an electropolishing polarity during the first set of electropolishing conditions and the second set of electropolishing conditions.

5. The apparatus of claim 1, wherein the first set of electropolishing conditions comprises a first substrate current density and the second set of electropolishing conditions comprises a second substrate current density less than the first substrate current density.

6. The apparatus of claim 5, wherein the first substrate current density is between about 60 $mA/cm^2$ and about 80 $mA/cm^2$ and the second substrate current density is between about 15 $mA/cm^2$ and about 40 $mA/cm^2$.

7. The apparatus of claim 5, wherein the first substrate current density is provided by a first cell voltage between about 10 volts and about 25 volts and the second substrate current density is provided by a second cell voltage between about 3 volts and about 10 volts.

8. The apparatus of claim 1, wherein the first set of electropolishing conditions comprises a first flow of an electropolishing solution and the second set of electropolishing conditions comprises a second flow of the electropolishing solution greater than the first flow of the electropolishing solution.

9. The apparatus of claim 8, wherein the first flow of the electropolishing solution is between about 0.0 GPM and about 0.5 GPM and the second flow of the electropolishing solution is between about 0.5 GPM and about 50 GPM.

10. The apparatus of claim 1, wherein the first set of electropolishing conditions comprises a first substrate potential and the second set of electropolishing conditions comprises a second substrate potential less than the first substrate potential.

11. The apparatus of claim 10, wherein the first substrate potential is between about 2.0 volts and about 1.9 volts and the second substrate potential is between about 1.6 volts and about 1.0 volts.

12. The apparatus of claim 1, wherein the first set of electropolishing conditions comprises a first concentration of an electrolyte in the electropolishing solution and the second set of electropolishing conditions comprises a second concentration of the electrolyte in the electropolishing solution less than the first concentration of electrolyte in the electropolishing solution.

13. The apparatus of claim 12, wherein the first concentration of the electrolyte in the electropolishing solution is between about 60% electrolyte by volume and about 85% electrolyte by volume and the second concentration of the electrolyte in the electropolishing solution is between about 25% electrolyte by volume and about 60% electrolyte by volume.

14. The apparatus of claim 1, wherein the first set of electropolishing conditions comprises a first temperature of an electropolishing solution and the second set of electropolishing conditions comprises a second temperature of the electropolishing solution greater than the first temperature of the electropolishing solution.

15. The apparatus of claim 14, wherein the first temperature is between about 10° C. and about 25° C. and the second temperature is between about 30° C. and about 65° C.

16. The apparatus of claim 1, wherein the first set of electropolishing conditions comprises a first rotational speed of the substrate and the second set of electropolishing conditions comprises a second rotational speed of the substrate greater than the first rotational speed.

17. The apparatus of claim 16, wherein the first rotational speed is between about 0 rpm and about 10 rpm and the second rotational speed is between about 10 rpm and about 100 rpm.

18. The apparatus of claim 1, wherein the electropolishing solution comprises:

copper ions in a concentration of 0.1 M or less; and an electrolyte in a concentration of at least 25% by volume, the electrolyte selected from the group consisting of phosphoric acid, potassium phosphate, phosphoric acid based electrolytes, sulfuric acid based electrolytes, and combinations thereof.

19. The apparatus of claim 18, wherein the electrolyte further comprises a phosphoric acid based electrolyte.

* * * * *

UNITED STATES PATENT AND TRADEMARK OFFICE

CERTIFICATE OF CORRECTION

PATENT NO. : 6,951,599 B2
APPLICATION NO. : 10/188163
DATED : October 4, 2005
INVENTOR(S) : Joseph Yahalom et al.

It is certified that error appears in the above-identified patent and that said Letters Patent is hereby corrected as shown below:

On the Title Page

Item [60], Related U.S. Application Data: Please change "60/350,875" to --60/350/876--

In the Specification

Column 7, Line 51: Change "Wishing" to --wishing--

Column 12, Line 61: Insert --V-- after "1.7"

Column 13, Line 2: After "thicker", change "a" to --at--

Column 13, Line 60: Change "$H_3PO4$" to --$H_3PO_4$--

Column 14, Line 43: After "dissolved", change "on" to --in--

Column 14, Line 52: After "ions", insert --in--

Signed and Sealed this

Nineteenth Day of September, 2006

JON W. DUDAS
*Director of the United States Patent and Trademark Office*

UNITED STATES PATENT AND TRADEMARK OFFICE

CERTIFICATE OF CORRECTION

PATENT NO. : 6,951,599 B2
APPLICATION NO. : 10/188163
DATED : October 4, 2005
INVENTOR(S) : Joseph Yahalom et al.

It is certified that error appears in the above-identified patent and that said Letters Patent is hereby corrected as shown below:

On the Title Page

Item [60], Related U.S. Application Data: Please change "60/350,875" to --60/350,876--

In the Specification

Column 7, Line 51: Change "Wishing" to --wishing--

Column 12, Line 61: Insert --V-- after "1.7"

Column 13, Line 2: After "thicker", change "a" to --at--

Column 13, Line 60: Change "$H_3PO4$" to --$H_3PO_4$--

Column 14, Line 43: After "dissolved", change "on" to --in--

Column 14, Line 52: After "ions", insert --in--

This certificate supersedes Certificate of Correction issued September 19, 2006.

Signed and Sealed this

Second Day of January, 2007

JON W. DUDAS
*Director of the United States Patent and Trademark Office*